US008365563B2

(12) United States Patent
Liu

(10) Patent No.: US 8,365,563 B2
(45) Date of Patent: Feb. 5, 2013

(54) METHODS FOR REDUCING RIDGE BUCKLES AND ANNEALING STICKERS IN COLD ROLLED STRIP AND RIDGE-FLATTENING SKIN PASS MILL

(75) Inventor: Yuli Liu, Toronto (CA)

(73) Assignee: Quad Engineering, Inc., Toronto, Ontario (CA)

( * ) Notice: Subject to any disclaimer, the term of this patent is extended or adjusted under 35 U.S.C. 154(b) by 464 days.

(21) Appl. No.: 12/619,021

(22) Filed: Nov. 16, 2009

(65) Prior Publication Data

US 2011/0113848 A1 May 19, 2011

(51) Int. Cl.
*B21B 37/58* (2006.01)
*B21B 23/00* (2006.01)

(52) U.S. Cl. ..... 72/10.4; 72/10.7; 72/366.2

(58) Field of Classification Search ..... 72/7.1, 72/7.4, 10.1, 10.4, 10.7, 234, 365.2, 366.2, 72/252.5

See application file for complete search history.

(56) References Cited

U.S. PATENT DOCUMENTS

| | | | | |
|---|---|---|---|---|
| 3,003,373 | A | 10/1961 | Volkhausen | |
| 3,024,679 | A | 3/1962 | Fox | |
| 3,077,800 | A * | 2/1963 | Taylor | 72/10.1 |
| 3,533,263 | A | 10/1970 | Wochnik et al. | |
| 3,686,907 | A * | 8/1972 | Sokolov et al. | 72/10.6 |
| 3,724,252 | A | 4/1973 | Baker et al. | |
| RE28,149 | E * | 9/1974 | Harbaugh et al. | 72/8.4 |
| 3,855,830 | A * | 12/1974 | Kitanosono et al. | 72/10.4 |
| 3,875,775 | A * | 4/1975 | Daniljuk et al. | 72/8.8 |
| 4,270,377 | A | 6/1981 | Verbickas et al. | |
| 4,531,394 | A | 7/1985 | Turley et al. | |
| 4,598,566 | A | 7/1986 | Bald et al. | |
| 4,599,883 | A * | 7/1986 | Ginzburg et al. | 72/234 |
| 4,614,103 | A | 9/1986 | Takagi et al. | |
| 4,676,844 | A * | 6/1987 | Satoh et al. | 148/504 |
| 4,781,050 | A | 11/1988 | Winter et al. | |
| 4,918,965 | A | 4/1990 | Kobayashi et al. | |
| 5,007,273 | A | 4/1991 | Kummerhoff | |
| 5,197,179 | A | 3/1993 | Sendzimir et al. | |
| 5,406,822 | A * | 4/1995 | Keller et al. | 72/234 |
| 5,873,277 | A * | 2/1999 | Bruestle | 72/7.4 |
| 6,536,254 | B1 * | 3/2003 | Kawalla et al. | 72/200 |
| 7,185,522 | B2 | 3/2007 | Turley | |

OTHER PUBLICATIONS

Yuli Liu, Jalal Biglou, Jian Fan, J. J. Fitzpatrick, Brian D. Nelson, "Strip Shape Simulation Software for Continuous Cold Rolling Process", Iron & Steel Technology (Apr. 2005), pp. 180-190.

Wanda M. Melfo, Rian J. Dippenaar, Christopher D. Carter, "Ridge-Buckle Defect in Thin-rolled Steel Strip", Iron & Steel Technology (Aug. 2006), pp. 54-61.

Yuli Liu, Jian Fan, Mike Levick, J. J. Fitzpatrick, Brian D. Nelson, "Three-dimensional Simulation of Local Shape Defects in Continuous Cold Rolling", Iron & Steel Technology (Aug. 2007) pp. 70-80.

"Sendzimir's 20-High Mills", Sendzimir Inc., online: Sendzimir Inc. http://www.sendzimir.com/products/20/.

* cited by examiner

*Primary Examiner* — Edward Tolan
*Assistant Examiner* — Lawrence J Averick
(74) *Attorney, Agent, or Firm* — DeLio & Peterson, LLC; Thomas E. Ciesco

(57) ABSTRACT

A method for flattening steel strip by cold rolling wherein the strip is passed through at least two cold rolling mill stands each having work rolls. A first mill stand has work rolls having local rigidity K significantly different from a second milled stand. The local rigidity K is calculated in Kgf/mm/mm in accordance with an equation. A six high mill comprises a pair of driven backup rolls disposed on the entry side, a pair of horizontal support rolls disposed on the exit side, and a pair of small diameter work rolls having an entry side face and an exit side face. The work rolls are disposed between the backup rolls and the support rolls, wherein during operation the entry side face of the work rolls engages the backup rolls and the exit side face of the work rolls engages the support rolls.

13 Claims, 15 Drawing Sheets

METHODS FOR REDUCING RIDGE BUCKLES AND ANNEALING STICKERS IN COLD ROLLED STRIP AND RIDGE-FLATTENING SKIN PASS MILL

FIELD OF INVENTION

The present invention relates to methods for reducing ridge buckles and annealing stickers in a cold rolled strip and to a ridge-flattening skin pass mill.

BACKGROUND

With the advancement of shape control actuators and the development of new shape control technologies, the shape quality of cold rolled strip has improved significantly in recent years. With the use of shape meters and closed loop controls, simple shape defects, such as edge waves and center waves, are no longer difficult to control. With the reduction of simple shape defects, the focus has turned to local shape defects. In many cases, local shape defects are the number one reason for customer rejection of cold rolled strip. Unlike simple waves, local shape defects are, usually related to abnormal rolling conditions, such as feed stock ridges yield stress local drop, improper roll cooling practice and roll cooling nozzle clogging etc., and are therefore difficult to control by the use of any existing shape control actuators in a cold mill (Liu et al, Three-dimensional Simulation of Local shape Defects in Continuous Cold Rolling, Iron & Steel Technology, August 2007, p 70-80). Although local shape defects may be caused by a variety of abnormal rolling conditions, the majority of local shape defects are caused by feed stock ridges (Melfo et al, Ridge-buckle Defect in Thin-rolled Steel Strip, *Iron and Steel Technology*, August 2006, p. 54-61) which are areas of local thickening in the feed stock as shown in FIG. 1. FIG. 1 is a transverse cross-section of a small portion of one surface of a feedstock strip 2, which is typically a hot rolled strip, having a single ridge 4. As seen in FIG. 1, the surface of feedstock 2 is uneven with the heavy line 6 denoting the nominal thickness of the feedstock.

Examples of local shape defects caused by feed stock ridges are ridge-buckles 8 as shown in FIG. 2 (Melfo et al, 2006 mentioned above). FIG. 2 shows a coil of cold rolled strip having ridge-buckles 8 and a characteristic build-up 10. Ridge-buckle defects typically consist of sinusoidal waveforms between 100 and 200 mm in width and up to around 3 mm in amplitude, and with a pitch of about 200-300 mm that appear in thin strip following cold rolling, annealing and tempering. The characteristic build-up 10 is basically caused by ridges remaining in the cold rolled strip. The remaining thickness ridges will induce high localized pressure between laps of the coil, which often cause the laps to stick together in subsequent batch annealing process, which defect is called annealing sticker.

The control and reduction of ridge-buckle defects and annealing stickers have been leading research topics in the field of flat rolling as existing shape control actuators cannot effectively control ridge-buckles (Melfo et al, 2006 mentioned above) and annealing stickers consistently cause large losses. So far, an effective solution for decreasing or eliminating the incidence of ridge-buckles had not been found.

SUMMARY OF INVENTION

In one preferred form of the present invention there is provided a method for flattening steel strip by cold rolling said strip by passing it through at least two cold rolling mill stands each having work rolls, wherein a first of said at least two mill stands has said work rolls having local rigidity K significantly different from the second of said at least two mill stands, wherein the local rigidity K is calculated in Kgf/mm/mm in accordance with the equation $$K = \frac{1}{\frac{c}{8}\left[\ln\left(\frac{2D}{\Delta h + cp}\right) - \frac{cp}{\Delta h + cp}\right]}$$

where

K—work roll local rigidity (Kgf/mm/mm)

p—roll force per unit strip width (Kgf/mm)

u—local work roll flattening (mm)

D—work roll diameter (mm)

E—work roll elastic modulus (Kgf/mm$^2$)

ν—poisson's ratio

Δh—local draft of the strip (mm)

where $$u = \frac{c}{8} p \ln\left(\frac{2D}{\Delta h + cp}\right)$$

and where $$c = \frac{16(1 - \upsilon^2)}{\pi E}.$$

It has been found in accordance with one aspect of the present invention that control and reduction of ridge-buckle defects and annealing stickers can be effected in a method wherein successive mill stands have work rolls exhibiting significantly different local rigidities K when determined according to the above formula.

In a further preferred form of the invention said strip is passed in sequence through initially said first and through subsequently said Second of said mill stands and wherein said work rolls of said first mill stand have significantly higher local rigidity K than said work rolls of said second mill stand. As described in more detail below particularly good results of control and reduction of ridge buckles and annealing stickers is achieved in a tandem cold mill having significantly higher local rigidity in an early stand or stands and/or significantly lower local rigidity in the later stand or stands.

In a further preferred form the invention relates to a novel six high-mill structure particularly well adapted to provide work rolls with high local rigidity for use in a preferred form of a method as described above.

BRIEF DESCRIPTION OF THE FIGURES

Preferred embodiments of the invention will now be described, by way of example, with reference to the accompanying drawings, in which.

Similar references are used in different figures to denote similar components.

DETAILED DESCRIPTION

Simulation software has been developed by applicant to model and predict how ridge-buckle defects can develop due to cold rolling when a hot rolled strip, also referred to herein as "feedstock", contains ridges.

The role of ridges in hot rolled strip and the formation of ridge-buckles following cold rolling was investigated. The simulation software was used to simulate a local shape defect induced by a local drop in yield stress, a profile ridge of feedstock, and a crown ridge of a work roll. The software can also simulate the effect of a feed stock residual stress ridge or valley and the effects of the mill stands having different local rigidities. Local rigidity describes the capability of a work roll to resist local flattening of the work roll and can be derived by taking the partial derivative of a specific roll force using the formula that provides the work roll flattening:

$$K = \frac{\partial p}{\partial u}$$

where

K—work roll local rigidity p—roll force per unit strip width u—local work roll flattening K is calculated in Kgf/mm/mm using the formula $$K = \frac{1}{\frac{c}{8}\left[\ln\left(\frac{2D}{\Delta h + cp}\right) - \frac{cp}{\Delta h + cp}\right]}$$

referred to above.

Figure 1:
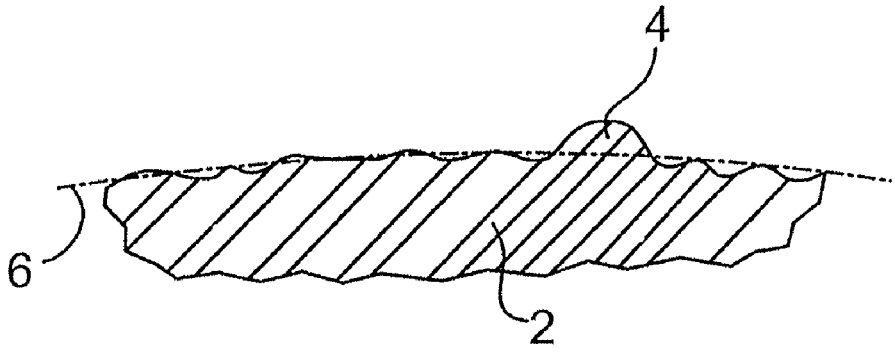
FIG. 1 is a cross section view of a surface portion of feedstock having a ridge.
Figure 2:
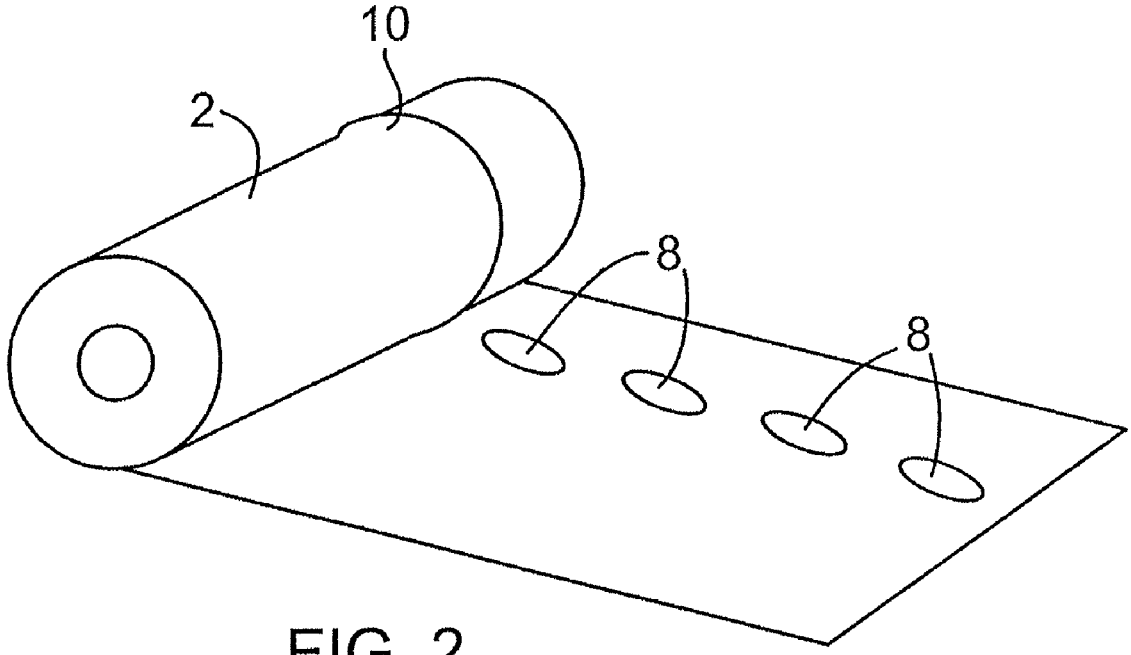
FIG. 2 is a perspective view of a cold rolled strip having multiple ridge-buckle defects.
Figure 3:
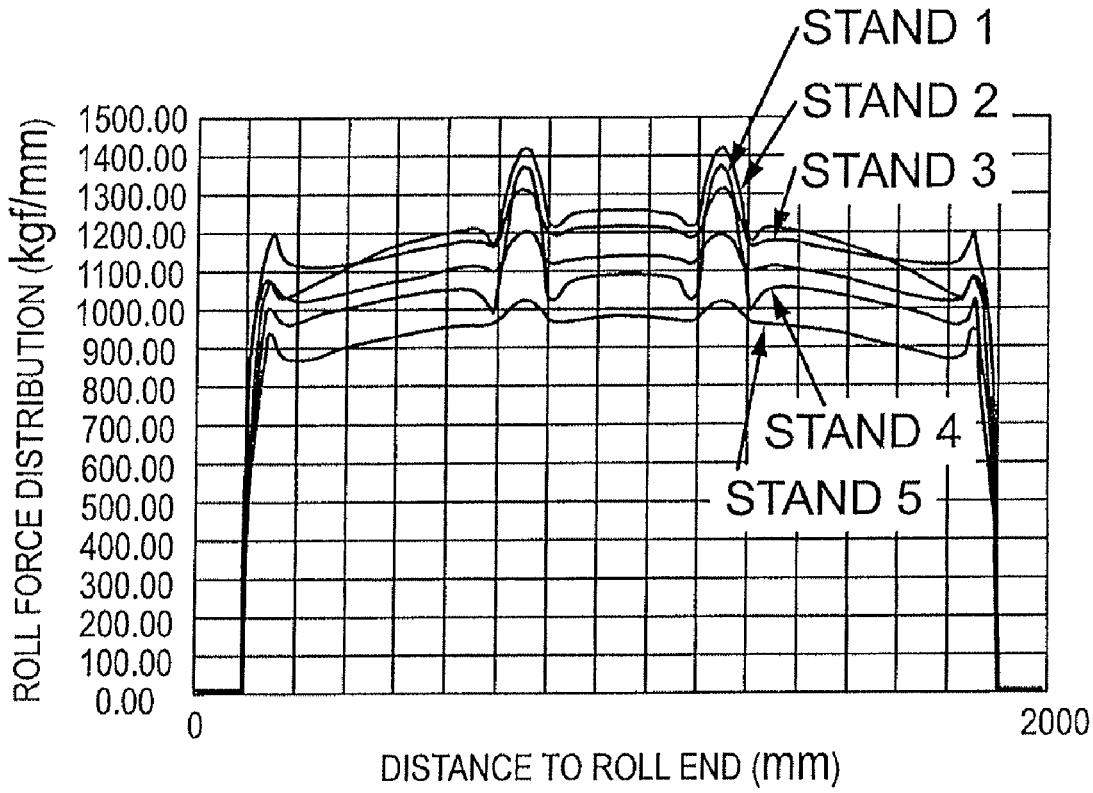
FIG. 3 is a line graph illustrating the specific roll force distribution along a width of a cold rolled strip at each subsequent stand of a conventional 5 stands 4 high cold mill (case study 1)
Figure 4:
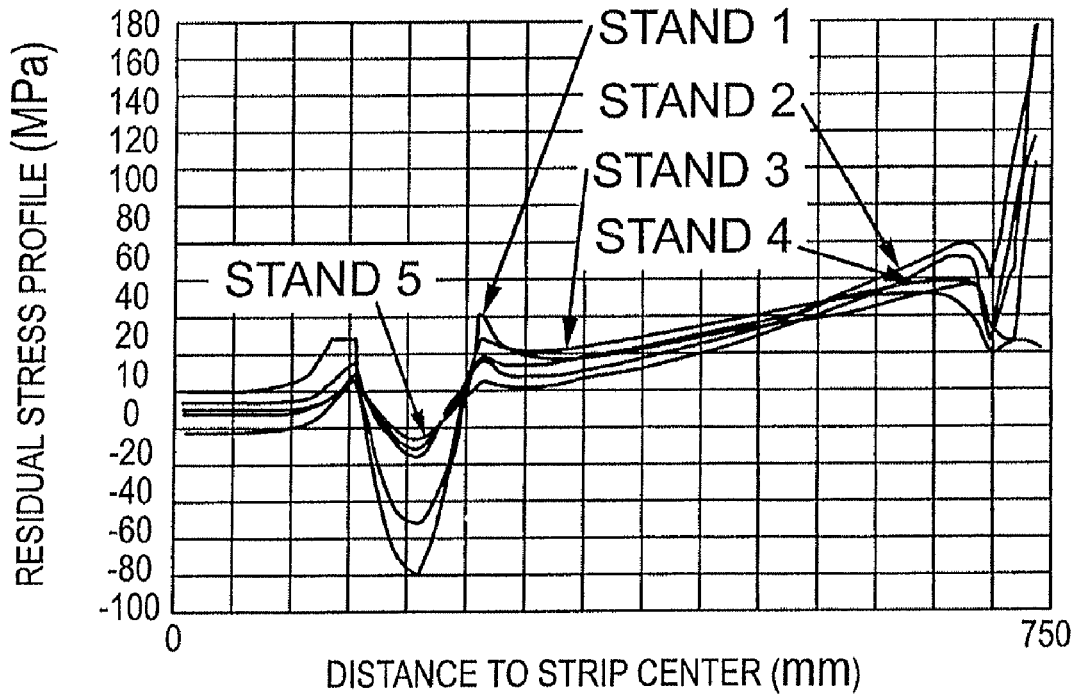
FIG. 4 is a line graph illustrating the residual stress in the cold rolled strip of FIG. 3, at each subsequent stand of the cold mill (case study 1)
Figure 5:
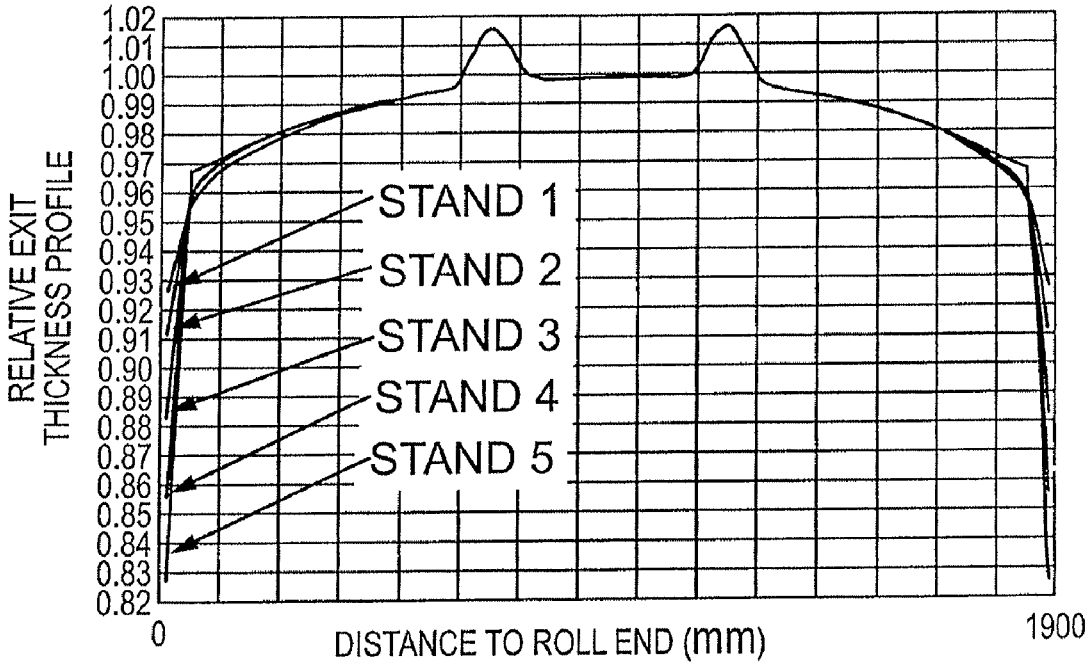
FIG. 5 is a line graph illustrating the relative thickness profile in the cold rolled strip of FIG. 3, at each subsequent stand of the cold mill (case study 1)

In a first case study, the simulation software was used to simulate and create models examining the events which occur during the cold rolling of the hot rolled strip in a conventional 4 high cold mill having five stands (case study 1) to provide a base case. In this case study, all work rolls that contact the strip have a local rigidity K of less than 12,000 Kgf/mm/mm. It was determined that large specific roll force peaks and local compression are produced at each stand of the cold mill when a ridge in the strip is directly rolled by the cold mill. FIG. 3, FIG. 4 and FIG. 5 show the selected simulation results for direct cold rolling a strip with two ridges symmetrically located about the center line of the strip. The height of the ridges was assumed to be 2% of the entry strip thickness, about 0.051 mm.

FIG. 3 shows the specific roll force distribution along the width of the strip. As seen in FIG. 3, it was determined that high peaks of specific roll force are induced by the additional draft at the ridge positions. At the first stand during the cold rolling process, the peaks are about 35% higher than the average specific roll force. At the second stand, the peaks are about 20% higher than the average specific roll force. At the last stand, the peaks are about 6% higher than the average specific roll force.

As seen in FIG. 4, it was determined that local compression stress was induced by the ridges. Even though the local compression stress was found to decrease upon subsequent rolling, it was found that approximately 30 MPa of compression stress remained in the final rolled product.

As seen in FIG. 5, the relative height of the ridges in the strip was reduced from 2% to approximately 1.5% of the entry strip thickness at the first stand. However, subsequent rolling did not substantially further reduce the relative height of the ridges. Ridges having a relative height of about 1.5% of the nominal product thickness were found to remain in the final product after undergoing multiple cold rolling. The large initial decrease in ridge height is due to the fact that the strip is at its thickest at the first stand and can easily flow laterally. Furthermore, prior to the first stand, local compression stresses have not yet been created in the strip.

In view of these simulation results, it was determined that the reduction of ridge height would be easiest at the first stand of a cold mill. Once the local compression stress is created after the first stand, and the strip is rolled thinner, it becomes more difficult to further reduce the relative height of the ridges.

The above simulation results show for the first time that large specific roll force peaks and local compression are produced at each stand of the cold mill when a ridge in the hot rolled strip is directly rolled by the cold mill.

In a second case study, the simulation software was used to simulate and create models examining the events which occur during the cold rolling of feedstock in a conventional 4 high cold mill having 5 stands and having a first stand having work rolls that contact the workpiece strip with a local rigidity K which is twice that of the cold mill of case study 1 (case study 2). The other conditions remained the same as for case study 1.

Figure 6:
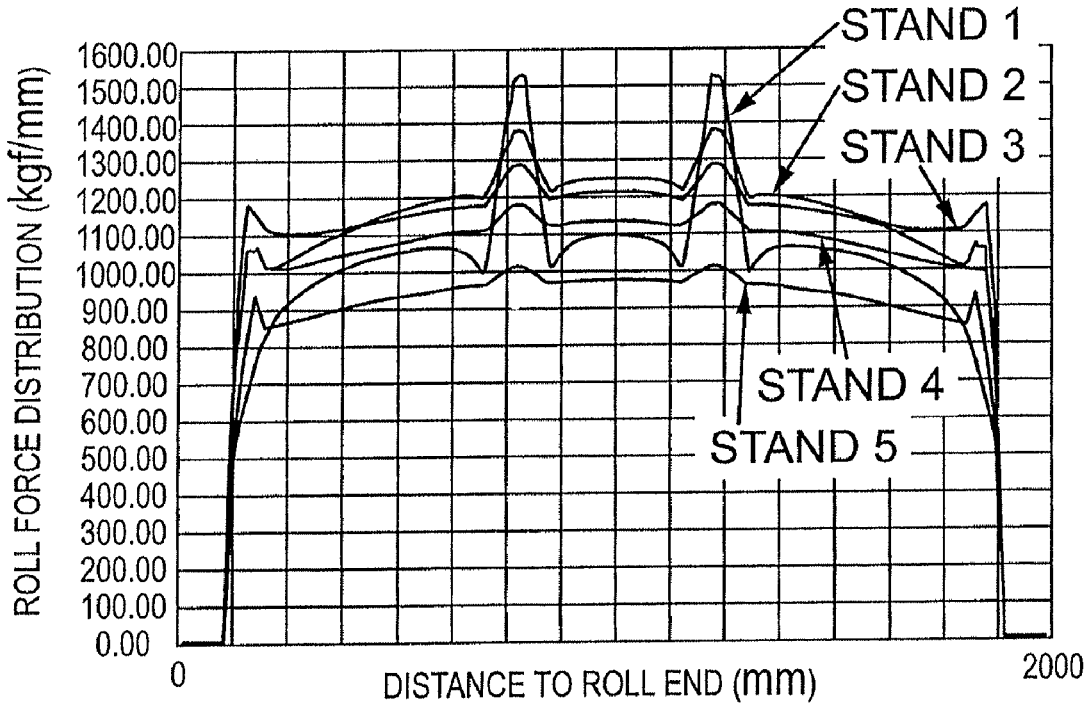
FIG. 6 is a line graph illustrating the specific roll force distribution along a width of a cold rolled strip at each subsequent stand of a conventional 4 high cold mill (case study 2) having a local rigidity at a first stand twice that of the cold mill of case study 1.

FIG. 6 shows the specific roll force distribution along the width of the strip for this case. Due to the higher local rigidity of the work rolls of the first stand, the peaks of the specific roll force at the first stand were observed to be higher as compared to case study 1. However, the peaks of the specific roll force at the second to last stand are much lower than case study 1. The remaining specific roll force peak was about 3% of the average specific roll forces, which is about half of that of case study 1.

Figure 7:
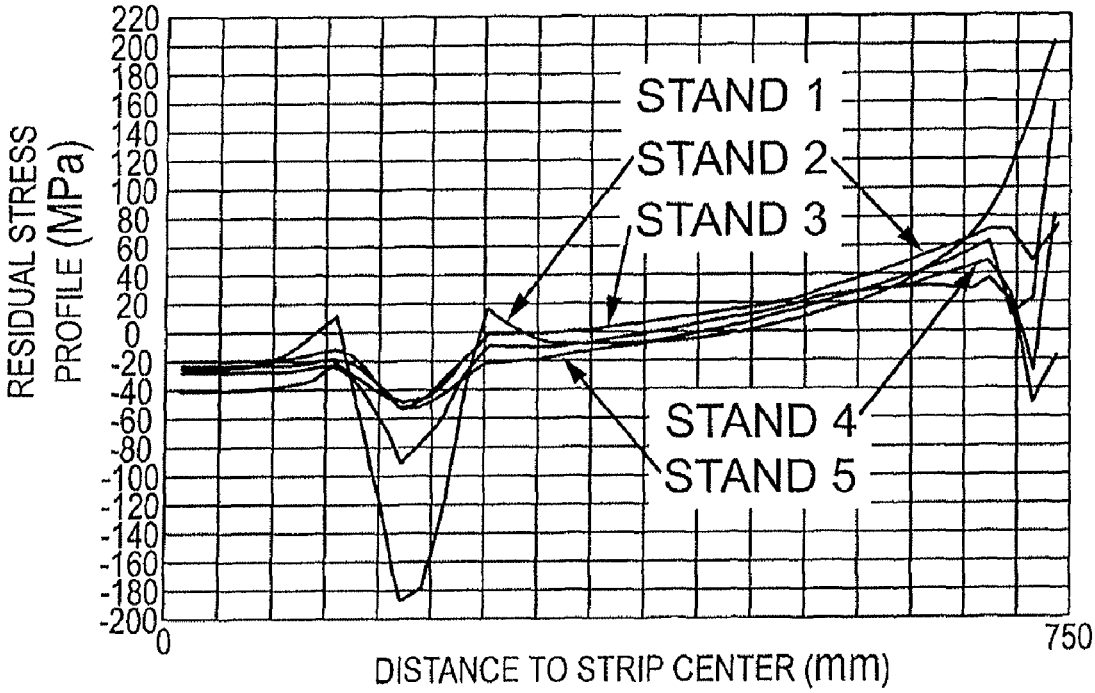
FIG. 7 is a line graph illustrating the residual stress in the cold rolled strip of FIG. 6, at each subsequent stand of the cold mill (case study 2)

Correspondingly the local residual stress after the second stand is also lower than that of case study 1, as shown in FIG. 7. The remaining local residual stress in the final product was approximately 22 MPa, which is about 27% lower than that of case study 1.

Figure 8:
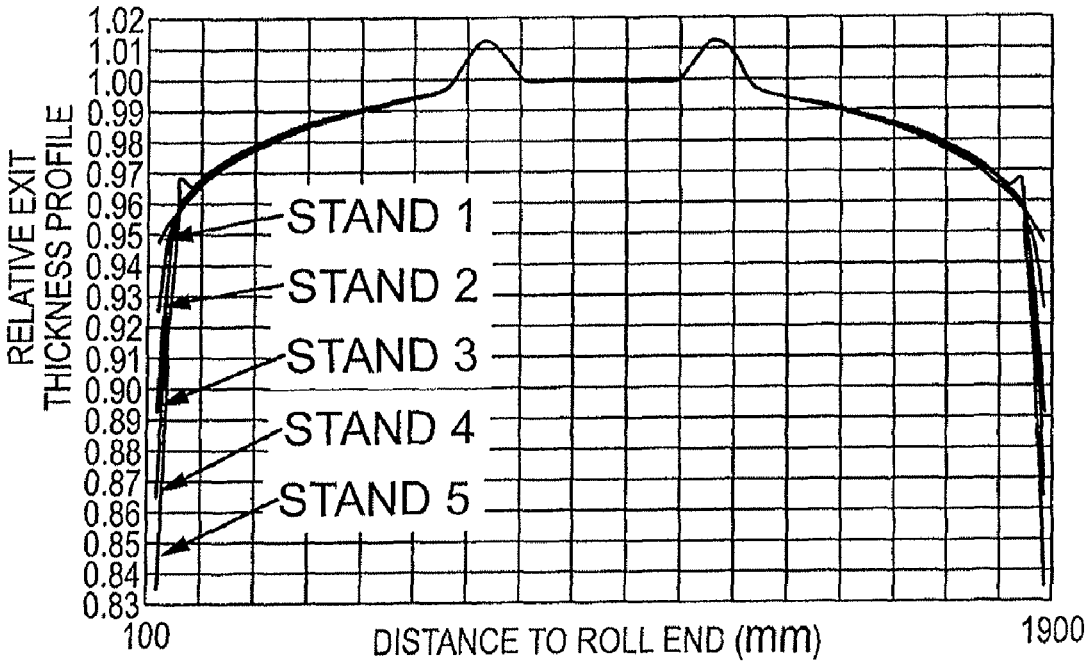
FIG. 8 is a line graph illustrating the relative thickness profile in the cold rolled strip of FIG. 6, at each subsequent stand of the cold mill (case study 2)

The difference of local rigidity K of the work rolls between the first stand and the second stand was determined to be the major contributing factor in the observed reduction of the local residual stress, since the local compression stress in the ridge areas were released due to the ridge height recovery at the second stand. The relative height of the ridge in the final product was about 1.15% as shown in FIG. 8, which is about 23% lower than that of case study 1. These results indicate that the higher local rigidity of the work rolls at the first stand contributed to the further reduction of the ridge height in the final product.

In a third case study, the simulation software was used to simulate and create models examining the events which occur during the cold rolling of feedstock in a conventional 4 high cold mill having a fifth or last stand having work rolls with a local rigidity which is 50% lower than the cold mill of case study 1 (case study 3). The other conditions remained the same as for case study 1.

Since all conditions from first stand to fourth stand in case study 3 were the same as those of case study 1, all the results from first stand to fourth stand 4 for case study 3 were also the same as those of case study 1. However, the results of fifth or last stand were significantly different between case study 3 and case study 1.

Figure 9:
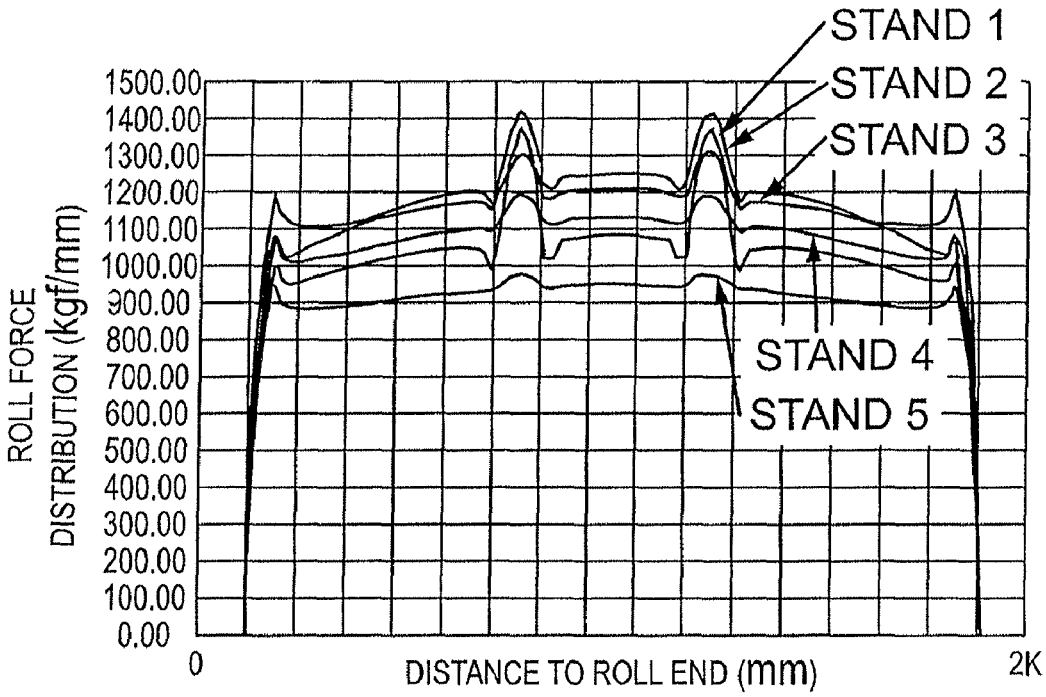
FIG. 9 is a line graph illustrating the specific roll force distribution along a width of a cold rolled strip at each subsequent stand of a conventional 4 high cold mill (case study 3) having a local rigidity at a fifth stand which is 50% lower than the cold mill of case study 1.
Figure 10:
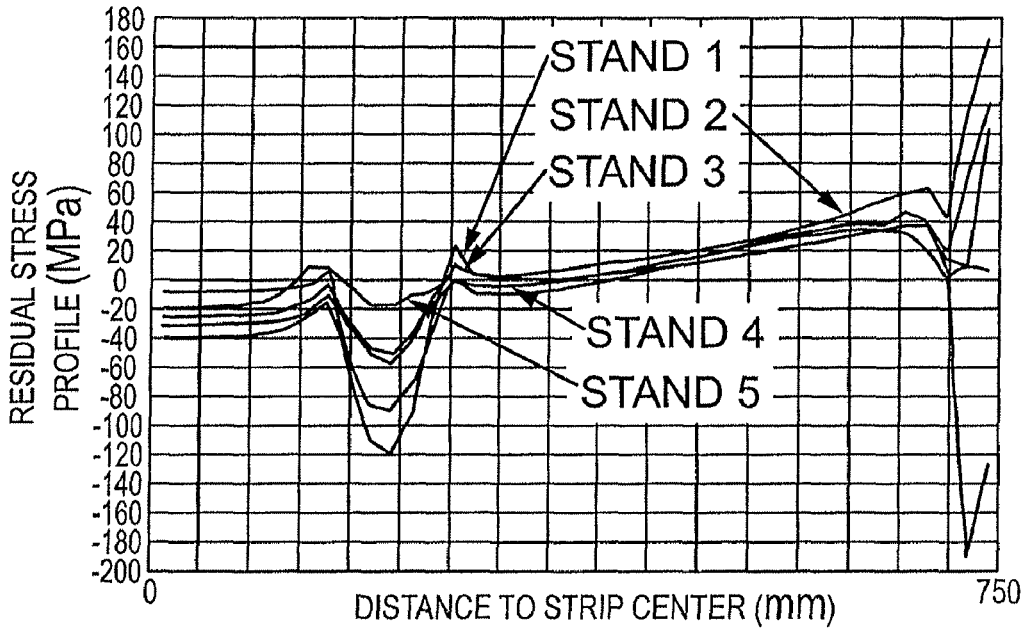
FIG. 10 is a line graph illustrating the residual stress in the cold rolled strip of FIG. 9, at each subsequent stand of the cold mill (case study 3)
Figure 11:
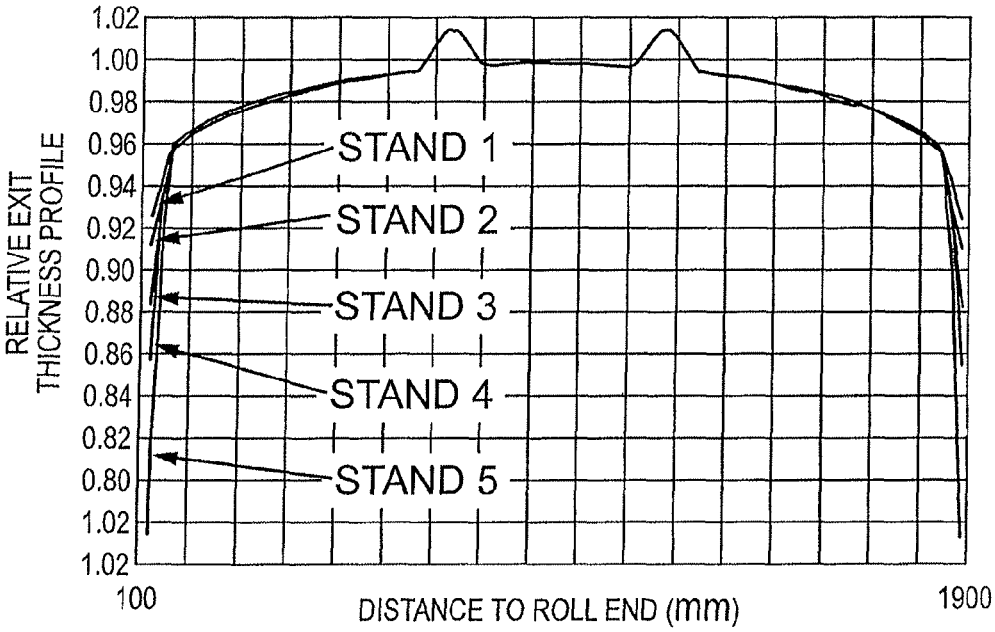
FIG. 11 is a line graph illustrating the relative thickness profile in the cold rolled strip of FIG. 9, at each subsequent stand of the cold mill (case study 3)

FIG. 9 shows the specific roll force distribution along the width of the strip for case study 3. Due to the lower local rigidity of the work rolls of the last stand, the peaks of the specific roll force at the last stand were about 3% of the average specific roll force, which was about half of that in case study 1. Correspondingly, the local residual stress at exit of last stand was also lower than that of case study 1, as shown in FIG. 10. The remaining residual stress in the final product was about 20 MPa, which was about 33% lower than that of case study 1.

The difference of local rigidity of the work rolls between the fourth stand and the fifth stand was determined to be the major contributing factor in the observed reduction of the local residual stress, since the local compression stress was released by the ridge height recovery at the fifth stand. The relative height of the ridge in the final product is about 1.6% as shown in FIG. 10, which was slightly higher than that of case study 1. The results showed that lower local rigidity at the last stand contributed to a lesser reduction of the ridge height in the final product.

The effect of flattening the ridges in the feedstock prior to cold rolling was then investigated. In a fourth case study, the simulation software was used to simulate and create models examining the events which occur during the cold rolling of pre-flattened feedstock in a conventional 4 high cold mill (case study 4). The software simulated the use of feedstock having ridges which are 91.6% flattened by a ridge-flattening skin pass mill having a work roll having very high local rigidity, prior to being fed into the cold mill. The other conditions remained the same as for case study 1.

Figure 12:
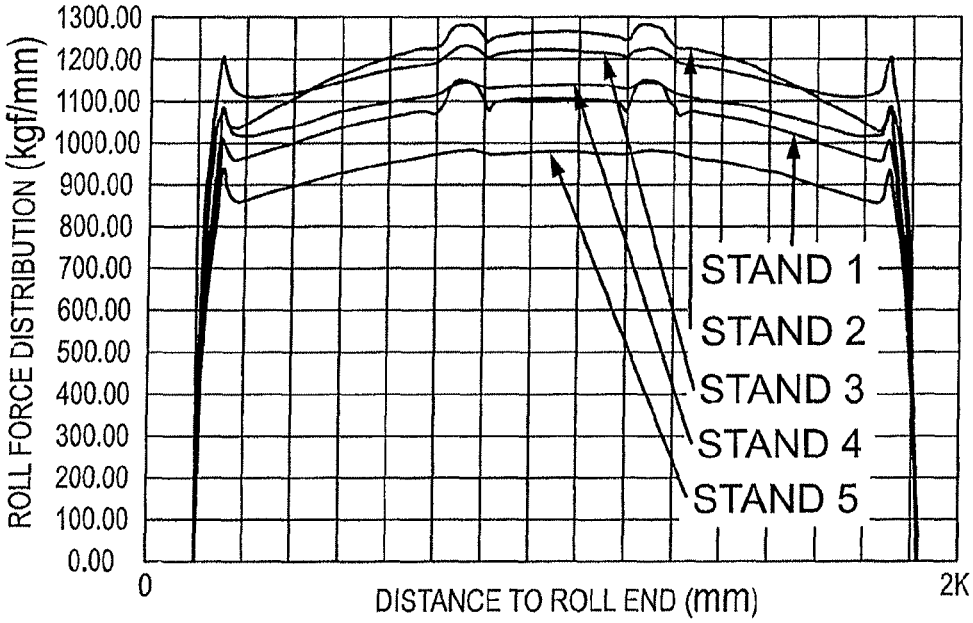
FIG. 12 is a line graph illustrating the specific roll force distribution along a width of a preflattened cold rolled strip at each subsequent stand of a conventional 4 high cold mill (case study 4)
Figure 13:
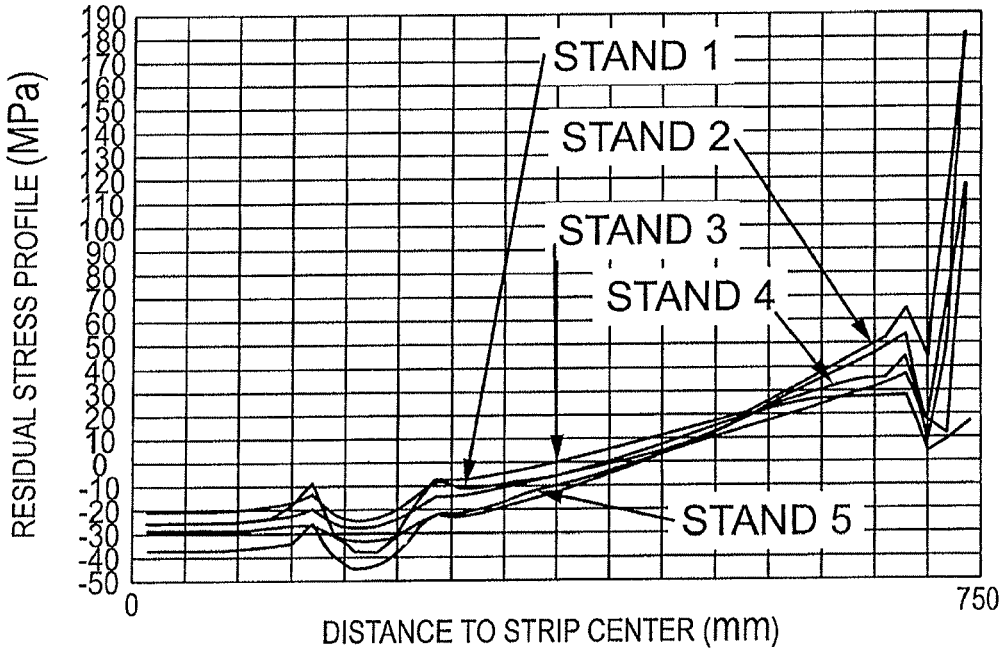
FIG. 13 is a line graph illustrating the residual stress in the preflattened cold rolled strip of FIG. 15, at each subsequent stand of the cold mill (case study 4)
Figure 14:
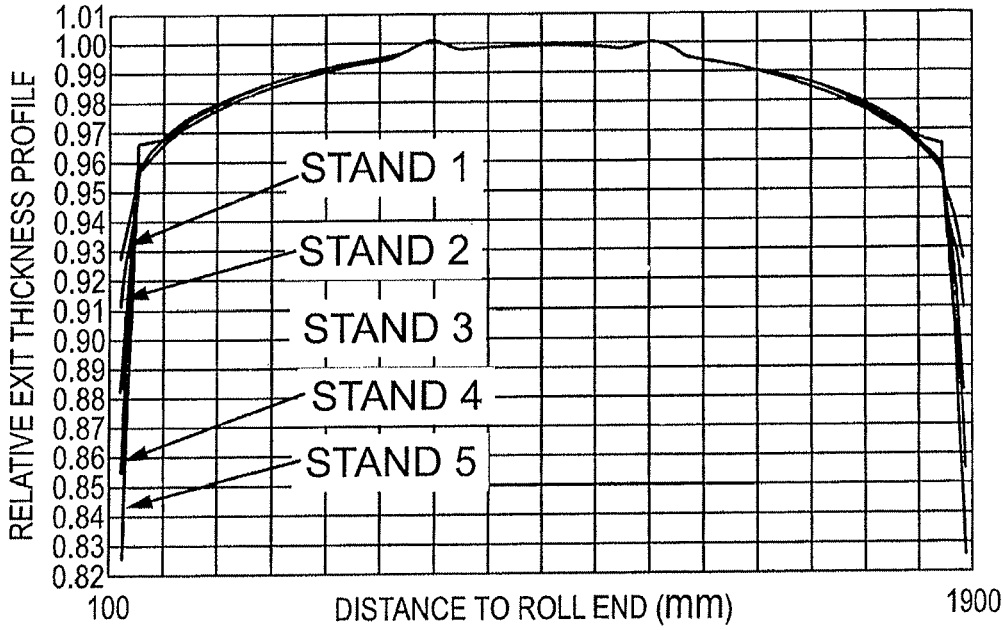
FIG. 14 is a line graph illustrating the relative thickness profile in the preflattened cold rolled strip of FIG. 15, at each subsequent stand of the cold mill (case study 4)

As shown in FIGS. 12, 13 and 14, even though a large residual stress is produced due to the flattening of the ridges in the feedstock, the majority of the large residual stress is released in the first pass of the cold rolling and the specific roll force peaks greatly reduced.

FIG. 12 shows the specific roll force distribution in the strip width at each stand of the cold mill. As seen in FIG. 6, there are still specific roll force peaks at the ridge positions due to the residual compression stress induced while flattening the ridges. However, the altitudes of the peaks are much smaller as compared to the specific force peaks observed in case study 1. At the first stand, the specific roll force peaks in the flattened strip are only about 4% of the average specific roll force.

FIG. 13 shows the local residual compression stress after each stand. FIG. 13 shows that only less than 20 MPa of residual stress is left after the first stand and only about 5 MPa residual stress is still remaining in the final product, which is about 83% lower than that of case study 1.

FIG. 14 shows the relative thickness profile after each stand. It can be seen that the ridges recovered a little after first stand. However, the relative height of the ridge did not substantially change at the subsequent stands. The height of the ridge is about 0.3% of the nominal thickness in the final product, which is about 80% less than that of case study 1.

The simulation results show that the specific roll force peaks, the residual stress and the thickness ridges are greatly reduced if the ridges are flattened before entering the cold mill. The maximum specific roll force peak is reduced from 35% to 4% of the average specific roll force, an about 90% of reduction. The local residual stress in the final product is reduced from 25 MPa to 5 MPa, an 80% of reduction. The height of the thickness ridge remaining in the final product is reduced from 1.5% to 0.3% of the nominal thickness, an 80% of reduction. The simulation shows that the difference between the local rigidity of the additional ridge-flattening skin pass mill stand and the cold mill stand was a major contributing factor in all of the above reductions.

Figure 15:
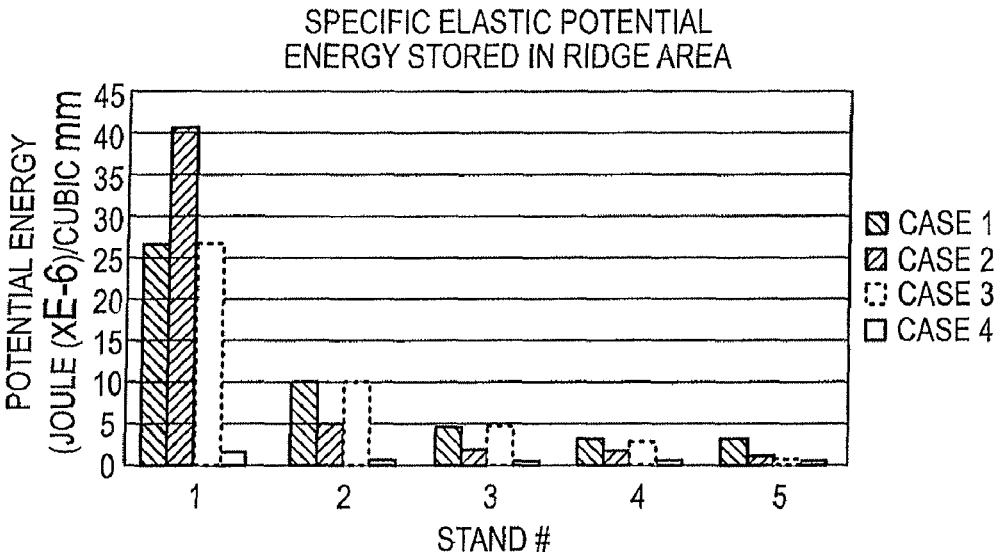
FIG. 15 is a bar graph comparing the specific elastic potential energy stored in the ridge area of the cold rolled strip at each subsequent stand for: the conventional 4 high cold mill (case study 1); the 4 high cold mill having a first stand of higher local rigidity (case study 2); the 4 high cold mill having a last stand of lower local rigidity (case study 3); and the conventional 4 high cold mill downstream of a ridge-flattening skin pass mill (case study 4)

From the view point of energy principle, the simulation results indicate that internal elastic potential energy is produced and stored in the ridge area of a feedstock strip when a ridge is partially flattened during rolling. The simulation software was able to trace the variation of the elastic potential energy stored in the ridge area of the strip and its effects to the strip and roll deformation in the roll bite. The simulation results showed that once a plastic flow condition is created for a strip locally stored with high elastic potential energy, the metal involved (strip and roll) will flow/deform in a way that the locally stored elastic potential energy will release itself. A small portion of the internal energy can be released through metal lateral flow and differential elongation, however, a major portion of the internal energy can be released through ridge height recovery if the local rigidity of the work roll is significantly lower than that of the previous stand. FIG. 15 shows the specific elastic potential energy stored in the ridge area for above four case studies. The results show that either significantly increasing the local rigidity of work rolls of early stands or significantly decreasing the local rigidity of work rolls of later stands can significantly reduce the elastic potential energy stored in the final product.

The investigations further show that the elastic potential energy stored in the ridge area of the final product can also be used as an index of ridge buckles. Since the internal elastic potential energy causes the local instability of the strip, under certain conditions, local buckling occurs to release the internal elastic potential energy and reach a new stable condition. The higher the elastic potential energy stored in the final strip, the higher the possibility of the buckling occurring.

Figure 16:
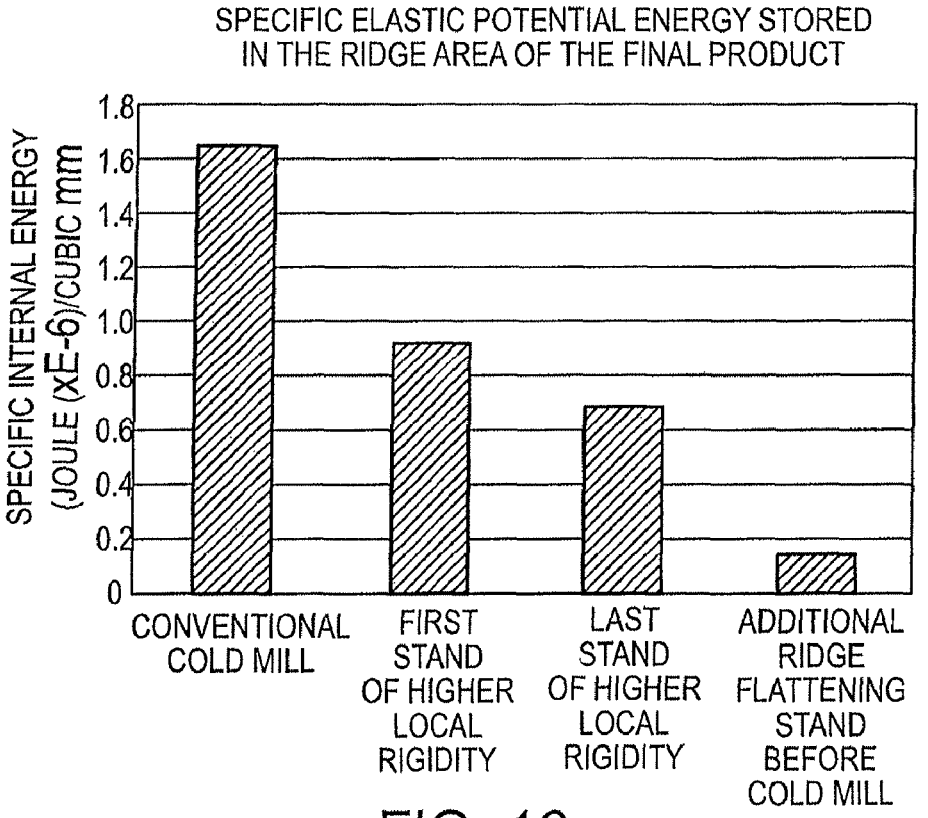
FIG. 16 is a bar graph comparing the elastic potential energy stored in the ridge area of the final cold rolled strip product for: the conventional 4 high cold mill (case study 1); the 4 high cold mill having a first stand of higher local rigidity (case study 2); the 4 high cold mill having a last stand of lower local rigidity (case study 3); and the conventional 4 high cold mill downstream of a ridge-flattening skin pass mill (case study 4)

FIG. 16 is a larger view of the specific elastic potential energy stored in the ridge area of the final product for the above four case studies. For case study 1, the specific elastic potential energy that remains is 1.66 E-6 Joule/mm$^3$. For case study 2, it is 0.91 E-6 Joule/mm$^3$, an approximately 45% reduction. For case study 3, it is 0.68 E-6 Joule/mm$^3$, an approximately 59% reduction. For case study 4, it is 0.13 E-6 Joule/mm$^3$, an approximately 92% of reduction.

The above comparison also shows that the most effective method to reduce ridge buckles is to use an additional ridge flattening skin pass mill stand before cold mill. As shown in FIG. 16, approximately 92% of ridge buckles can be reduced using this method. Additionally, a small portion of the ridge is also recovered at a first pass due to increased local roll flattening at the ridge position. This ridge recovery also greatly reduces the residual stress after the first pass. Therefore, only a small portion of the residual stress remains in the strip after the first pass. Moreover, the ridge material tends to spread laterally during ridge flattening since there is less restriction from the material at the two sides of the ridge. The lateral spread also help to reduce the incidence and amplitude of local buckles in the final product.

The fact that lowering the local rigidity of the work rolls of the last stand of a cold rolling mill is helpful to release the elastic potential energy stored in the strip also provides new theoretical guidance for temper mill design. The simulation results show that the use of work roll material of low elastic modulus and of larger roll diameter to reduce the local rigidity of the mill, is helpful to release the elastic potential energy stored in the strip and to improve the strip shape.

Based on the present discoveries, the present invention in one aspect provides methods for reducing the incidence and amplitude of ridge-buckles in cold rolled strip and rolling mills having work rolls having high local rigidity which are useful for flattening ridges in feedstock. The methods and rolling mills described herein can be used in conjunction with conventional cold rolling methods and cold mills. Even though a large compression stress is induced during ridge flattening, the hot rolled strip can still be flat checked with conventional buckling criteria as the flattened strip has not undergone any reduction in gauge and the compression area is narrow.

In addition to reducing the incidence and amplitude of ridge-buckles, use of the rolling mills described herein greatly reduces the remaining ridges of the final products, which reduces the occurrence of annealing stickers. Another benefit to flattening feedstock ridges prior to cold rolling is to reduce the possibility of roll failure in a cold mill, since the large specific roll force peaks induced by the ridges in the cold mill can greatly contribute to roll failure. Accordingly, the reduction of specific force peaks allows local roll wear to be reduced and the rolling campaign and roll life to be increased. In mills with a closed loop shape control system having segmented roll cooling, local ridge buckles tend to induce enhanced local roll cooling, which also has a negative effect on roll life. Thus, flattening feedstock ridges before cold rolling can avoid this problem.

In one preferred embodiment, the present invention provides a method for reducing the incidence and amplitude of ridge-buckles in cold rolled steel strip comprising the steps of: passing a steel strip to be cold rolled through a rolling mill comprising work rolls having high local rigidity to provide a flattened steel strip, and passing the flattened steel strip through a cold mill.

As used herein, the expression "flattened steel strip" refers to strip which at least a portion of pre-existing ridges in the strip are flattened such that the former areas of the strip occupied by the ridges are substantially the same thickness as the overall nominal thickness of the steel strip.

In a preferred embodiment, at least 50% of the ridges in the strip are flattened by passing the steel strip through the rolling mill comprising work rolls having high local rigidity. In a further preferred embodiment, at least 75% of the ridges in the strip are flattened by passing the steel strip through the rolling mill. In a still further preferred embodiment, at least 90% of the ridges in the strip are flattened by passing the steel strip through the rolling mill.

To reduce the incidence and amplitude of ridge buckles to an acceptable level, ridges in the strip are flattened using a rolling mill comprising work rolls having high local rigidity. The term "local rigidity" is defined as follows and describes the capability of a work roll to resist local flattening:

$$K = \frac{\partial p}{\partial u}$$

$$u = \frac{c}{8} p \ln\left(\frac{2D}{\Delta h + cp}\right)$$

$$c = \frac{16(1 - \upsilon^2)}{\pi E}$$

-continued $$K = \frac{1}{\frac{c}{8}\left[\ln\left(\frac{2D}{\Delta h + cp}\right) - \frac{cp}{\Delta h + cp}\right]}$$

where

K—work roll local rigidity (Kgf/mm/mm)

p—roll force per unit strip width (Kgf/mm)

u—local work roll flattening (mm)

D—work roll diameter (mm)

E—work roll elastic modulus (Kgf/mm$^2$)

ν—poisson's ratio

Δh—local draft of the strip (mm)

The greater the amount of roll flattening under a given rolling pressure, the smaller the local rigidity of the roll. The above formula shows that from the view point of rolling equipment, only two factors can significantly influence the local rigidity of a roll: (1) the work roll diameters and (2) the elastic modulus of the work roll material. The local rigidity of a roll increases as the roll diameter decreases, and as the elastic modulus of the roll material increases.

In a preferred embodiment, the work rolls have a local rigidity of between about 12,000 kgf/mm/mm and about 120,000 kgf/mm/mm, wherein the local rigidity in calculated in accordance with the above formula.

Skin pass mills are well known in the art and are used for adjusting the metallurgical properties, flatness and surface finish of rolled strip. However, conventional skin pass mills cannot be used to practice the presently disclosed method. Conventional two high, four high or six high skin pass mills are characterized by the relatively large size of their back up rolls and work rolls. Conventional skin pass mills are not suitable to be used as ridge flattening skin pass mill stand since the local rigidity of conventional skin pass mills are too low to flatten the ridges effectively. Since the work roll diameter of conventional skin pass mills is large, and the elastic modulus is relatively small, the local rigidity of the work rolls is low. Accordingly, as the work rolls are severely flattened at the positions contacted to the strip ridges, only a small portion of the ridges occurring in feed stock can be flattened by conventional skin pass mills.

To provide a rolling mill comprising work rolls having a high local rigidity, the work rolls should have a very small diameter and a very large elastic modulus. Preferably, the work rolls should have a diameter which is about ⅕ to ⅙ the diameter of work rolls for conventional 4 high mills. Typically, the diameter of the work rolls will be about 10 mm to 200 mm or approximately between ¼ to ⅙ the diameter of the backup roll diameter. The work rolls are preferably tungsten carbide work rolls which have an elastic modulus more than two times higher than that of steel. Preferably the work rolls comprise a material having an elastic modulus value between about 50,000 kgf/mm$^2$ to 70,000 kgf/mm$^2$.

Cluster mills and other multi-roll cold mills, such as Sendzimir mills, when small diameter tungsten carbide work rolls are used, can be used to flatten ridges in feedstock. Accordingly, in one preferred embodiment of the method, a clusters mill such as a 1700 mm, Sendzmir 20 high cold mill, modified, for example, to employ small diameter high elastic modulus such as tungsten carbide work rolls, can be used to flatten feedstock ridges prior to cold rolling.

While cluster mills having small diameter tungsten carbide work rolls can be used to practice the presently disclosed method for reducing the incidence and amplitude of ridge-buckles, these mills are generally very expensive.

In another aspect, one preferred embodiment of the present invention provides a novel six high mill that can provide work rolls with high local rigidity which are capable of efficiently flattening ridges in steel strip, and in particular, hot rolled strip intended for cold rolling. The six high mill according to one preferred embodiment of the present invention provides a cost effective and simple to operate alternative to conventional cluster mills. As the said six high mill is intended primarily for the flattening of ridges in feed stock, complicated shape adjustment mechanisms are not required. The use of very small diameter work rolls allows for the use of smaller backup rolls. Accordingly, the overall size of the six high mill is much smaller than conventional mills. As the six high mill of one preferred embodiment of the present invention is small in size and requires less control requirements, the cost of manufacturing the mill of the present invention is much less than conventional skin pass mills.

In one embodiment, the present invention provides a six high mill for flattening steel strip, the mill having an entry side where the strip enters the mill and an exit side where the strip exits the mill. The mill comprises a pair of driven backup rolls disposed on the entry side of the mill; a pair of horizontal support rolls disposed on the exit side of the mill; a pair of small diameter work rolls having high local rigidity, said work rolls having an entry side face and an exit side face, wherein said work rolls are disposed between the pair of backup rolls and the pair of support rolls; and wherein said the entry side face of the work rolls is in engagement with the backup rolls during operation and the exit side face of the work rolls is in engagement with the support rolls during operation.

The six high mill of one preferred embodiment of the present invention is distinguished from conventional two high, four high and six high skin pass mills and other types of non-cluster mills through the use of small diameter work rolls that may in use provide high local rigidity. The arrangement of backup rolls 20, 22, work rolls 30, 32 and horizontal support rolls 40, 42 is as shown in cross-section in FIG. 17. The arrow 60 indicates the horizontal direction in which strip 50 is passed through the mill 18 from the entry side of mill to the exit side mill. The backup rolls 20, 22, work rolls 30, 32 and horizontal support rolls 40, 42 can be rotatably mounted to a frame using prior art chocks (not shown) and methods known in the art.

The pair of backup rolls 20, 22 consists of an upper backup roll 20 and a lower backup roll 22. The centres 24, 26 of backup rolls 20, 22 define a usually vertical axis 28.

The pair of work rolls 30, 32 is positioned between the backup rolls 20, 22 and the horizontal support rolls 40, 42. The work rolls 30, 32 are disposed offset to axis 28 defined by the centres 24, 26 of the backup rolls 20, 22 at an offset distance 70 towards the exit side of the mill 15. In an alternative embodiment, the work rolls 30, 32 are disposed offset to axis 28 defined by the centres 24, 26 of the backup rolls 20, 22 at an offset distance 70 towards the entry side of the mill 15 (not shown). Generally, the offset distance 70 will be between about 25% and 35% of the diameter of the backup rolls 20, 22.

Figure 17:
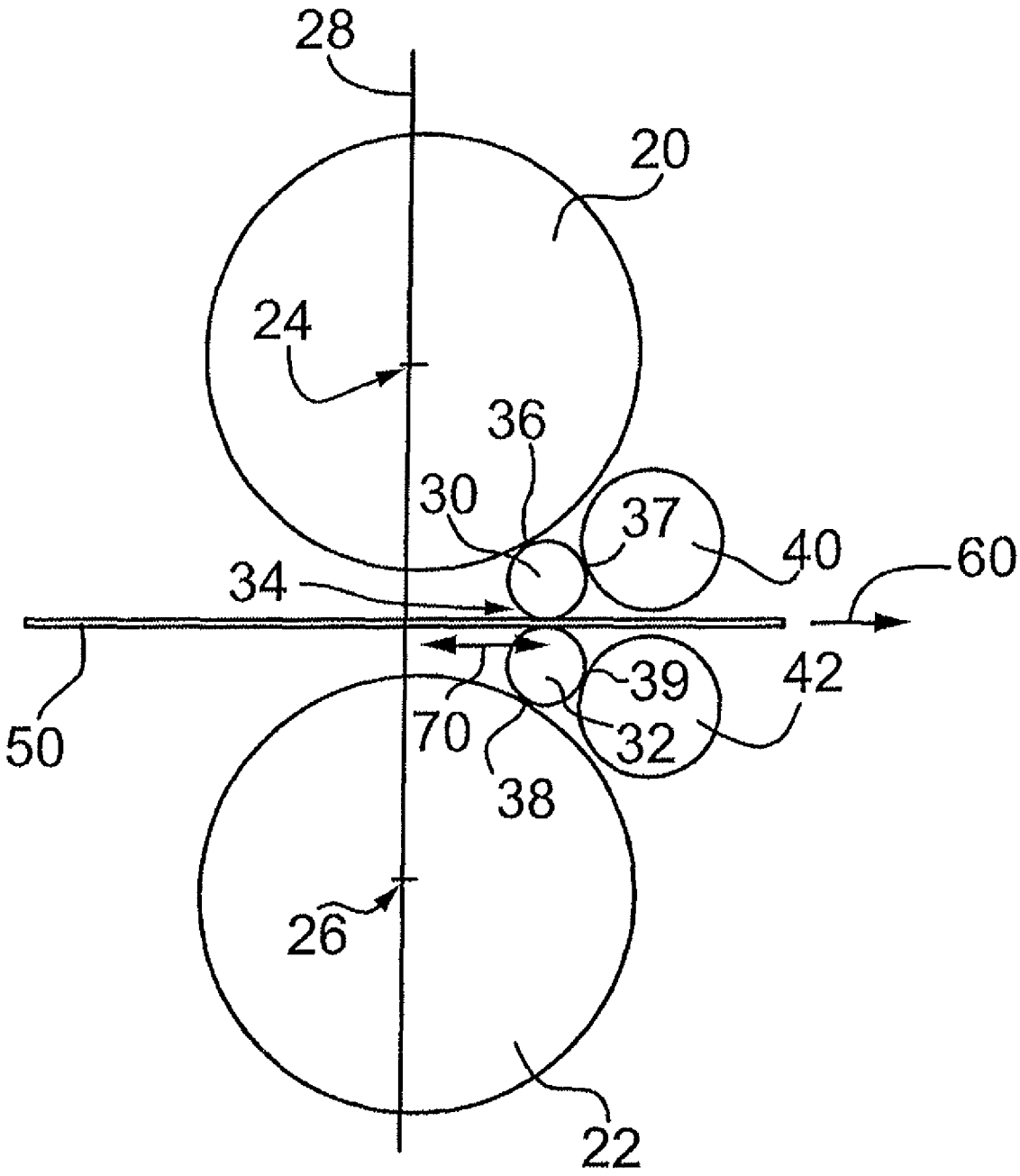
FIG. 17 is a schematic cross-sectional view of a six high mill in accordance with an embodiment of the present invention.

The pair of work rolls 30, 32 consists of an upper work roll 30 and a lower work roll 32 which are mounted on opposites sides of a strip pass line (superimposed by strip 50 in FIG. 17). The centre of the rolls 30, 32 define an axis preferably substantially parallel to the axis 28 and the rolls 30, 32 define a roll bite 34. During operation, strip is fed into the mill on the entry side passes in a horizontal direction through the roll bite 34 to the exit side of the mill.

In a preferred embodiment, in use, the work rolls 30, 32 have a local rigidity K of between about 12,000 kgf/mm/mm and about 120,000 kgf/mm/mm, wherein the local rigidity in calculated in accordance with the above formula. The work rolls 30, 32 are preferably made of tungsten carbide. The diameter of the work rolls 30, 32 is preferably about ⅕ to ⅙ the diameter of work rolls for conventional 4 high mills. Typically, the diameter of the work rolls 30, 32 will be about 10 mm to 200 mm.

Each of the work rolls 30, 32 is backed by one of the driven backup rolls 20, 22. As seen in FIG. 17, a portion of the entry side face 36, 38 of each work roll 30, 32 can engage a respective backup roll 20, 22. Since the roll force needed to flatten ridges using small diameter work rolls having high local rigidity is very small, and it is desirable that the work rolls be able to deflect according to the crown of the feedstock, the size of the backup rolls should be much smaller than the backup rolls in conventional skin pass mills. As compared to conventional rolling mills having very large diameter backup rolls, the diameter of the backup rolls 20, 22 of the six high mill of the present invention is similar in size to the work rolls of conventional 4 high mills. The diameter of the backup rolls 20, 22 is preferably between about 100 mm to 800 mm.

Each of the work rolls 30, 32 is supported by a respective horizontal support rolls 40, 42 to keep the work rolls 30, 32 horizontally stable. As seen in FIG. 17, a, portion of the exit side face 37, 39 of each work roll 30, 32 can engage a respective horizontal support roll 40, 42. There is no requirement for complex support systems as seen in prior art mills as the mill only requires high local rigidity in the work rolls but relatively low transverse rigidity as it is preferable to allow the work rolls to bend in accordance the strip profile.

The six high mill of the present invention can be constructed using methods and materials known in the art.

The six high mill of the present invention can be used in conjunction with all types of cold mills. Typically, a cold strip mill will comprise an upstream pickling line and a downstream cold rolling mill. The six high mill can be installed in a pickle line, at the entry side of a cold rolling mill, or any appropriate place in between. If the skin pass mill is installed at the entry of the pickle line, the six high mill can also be used as a scale breaker to improve the pickling efficiency. If the six high mill is installed between the pickling line and the cold rolling mill, it can also be used as an oil applier to apply oil for protecting the surface of the cold rolling mill or to enhance lubrication. If the six high mill is installed at the entry side of the first stand of a high speed continuous mill, it can also be used as a strip stabilizer.

Figure 18:
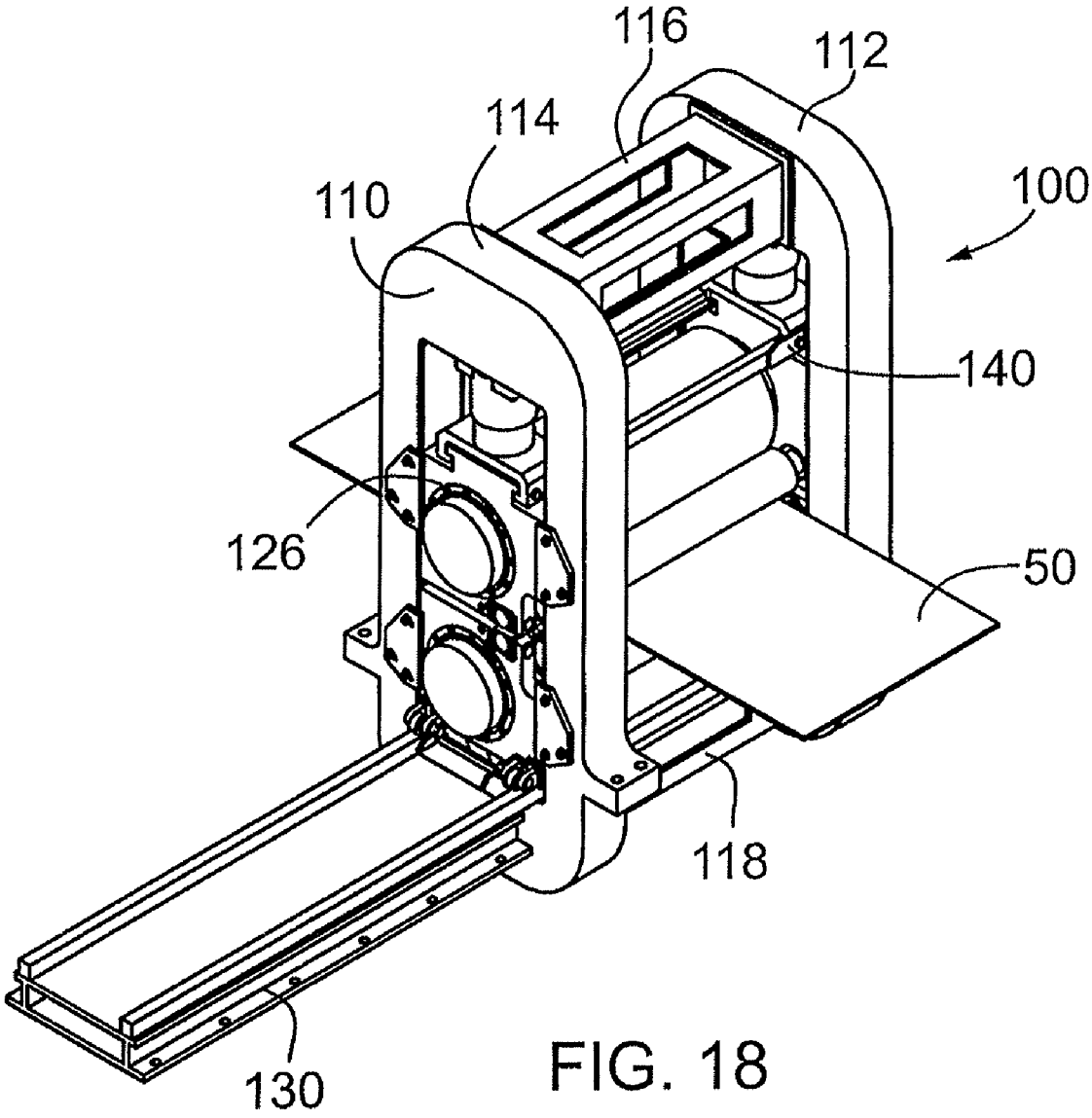
FIG. 18 is a perspective view of six high mill in accordance with an embodiment of the present invention comprising a roller assembly within a housing.

FIGS. 18 to 23 illustrate a six high mill constructed according to the teachings of a preferred embodiment of the present invention. As shown in FIG. 18, the six high mill 100 comprises a frame 110 having spaced substantially parallel upright members 112 and 114 connected by cross members 116 and 118. The frame 110 may be further provided with a suitable base for securing the frame 110 on a supporting surface.

Figure 19:
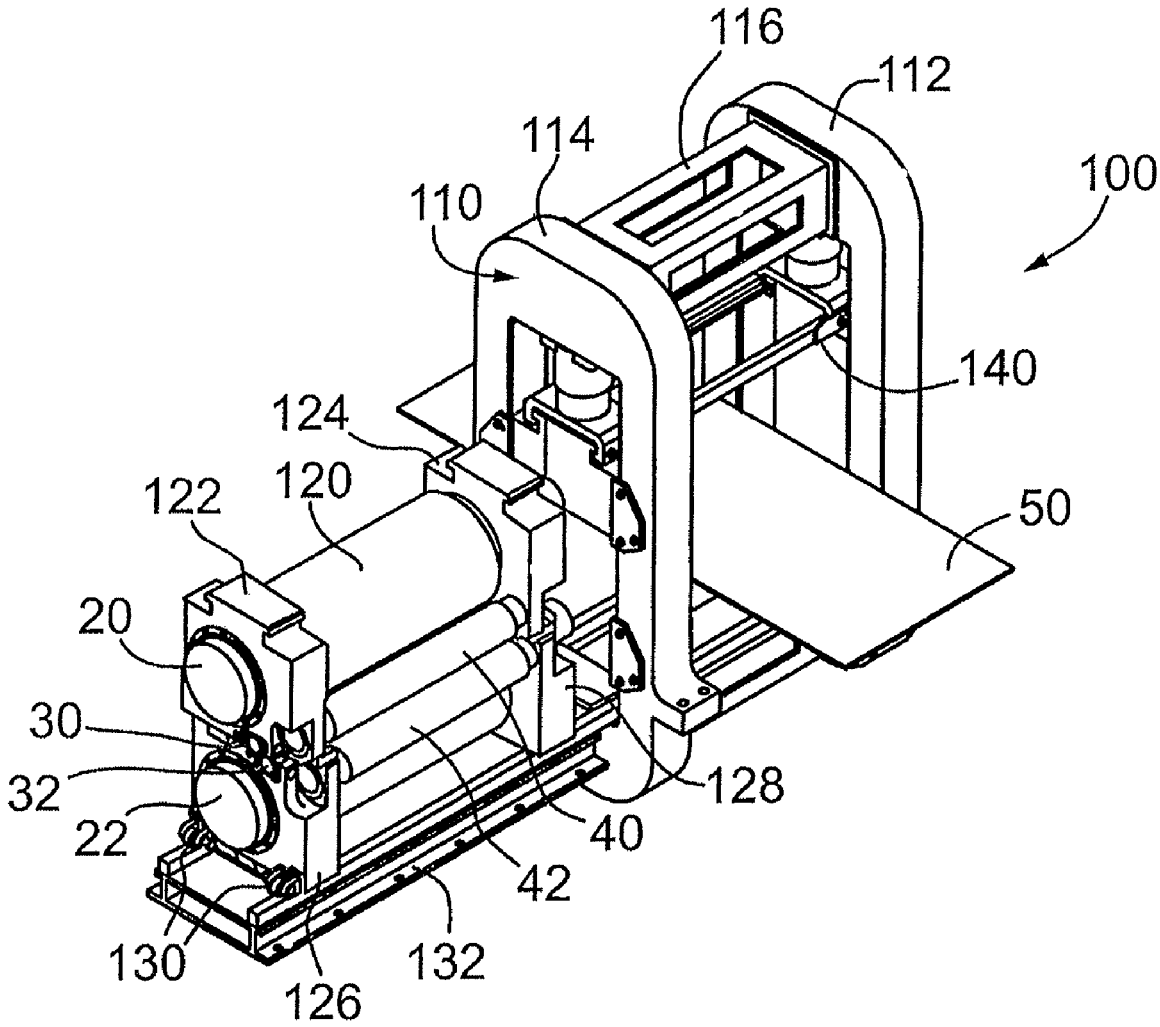
FIG. 19 is a perspective view of the six high mill shown in FIG. 18 wherein the roller assembly is extended outside the housing.
Figure 21:
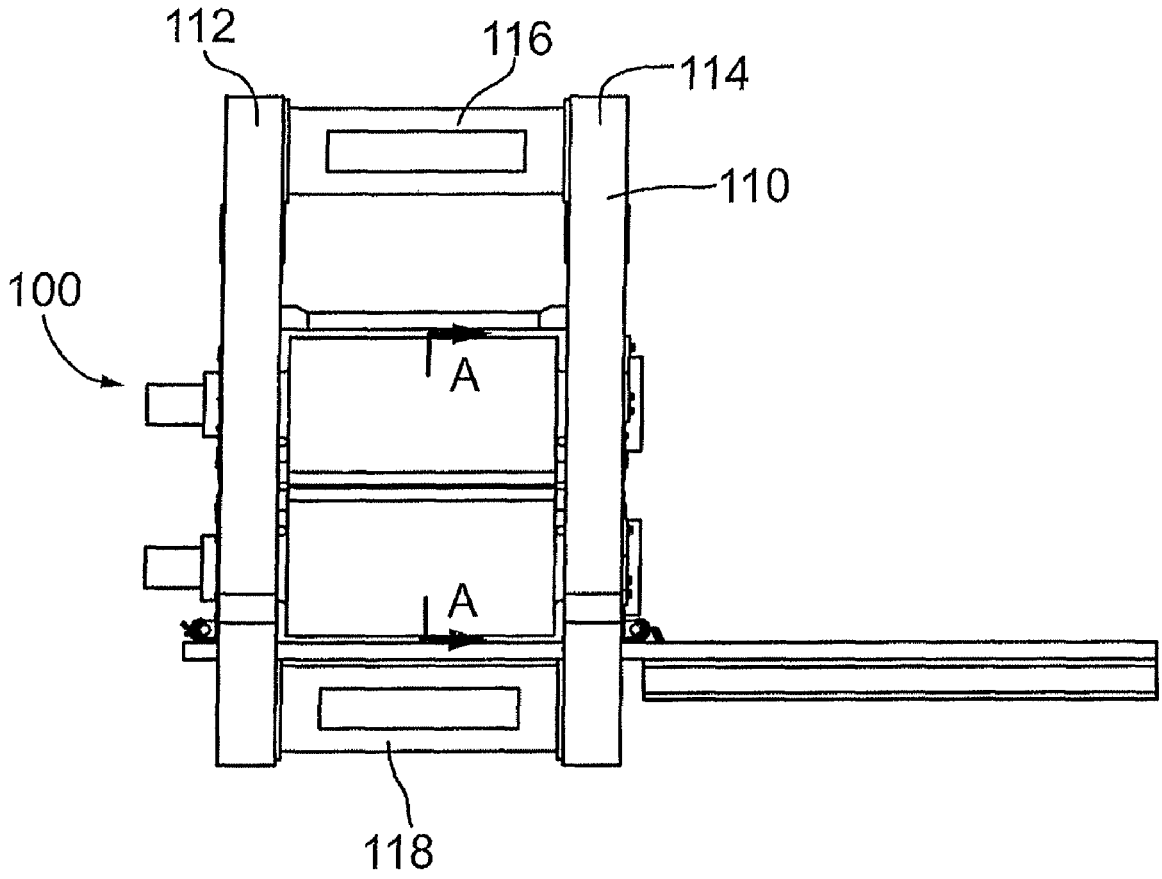
FIG. 21 is a rear view of the six high mill shown in FIG. 18.

As shown in FIG. 19, the six high mill 100 comprises a pair of backup rolls 20, 22, a pair of work rolls 30, 32 and a pair of support rolls 40, 42 which together comprise a roll assembly 120 which is housed in carriage 122. Carriage 122 comprises substantially spaced parallel upright members 124 and 126 to which the backup rolls 20, 22, work rolls 30, 32 and support rolls 40, 42 are mounted by conventional methods. Carriage 122 is fitted with rollers 130 for slidably engaging track 132 mounted to cross member 118 of frame 110. As shown in FIGS. 18 and 21, one end of track 130 extends substantially beyond the perimeter defined by frame 110 allowing carriage 122 to be rolled in and out of frame 110.

FIG. 18 shows the six high mill 100 set up for operation with the carriage 122 and roll assembly 120 positioned within frame 110 and having a steel strip 50 received in between the work rolls 30, 32. The six high mill 100 further comprises support assembly 140 mounted to cross member 116 for receiving and securing carriage 122 to the frame 110 during operation.

FIG. 19 shows the configuration of the six high mill 100 with the carriage 122 and roll assembly 120 removed from the frame 110 to allow for easy access to the roll assembly for maintenance and repairs.

Figure 20:
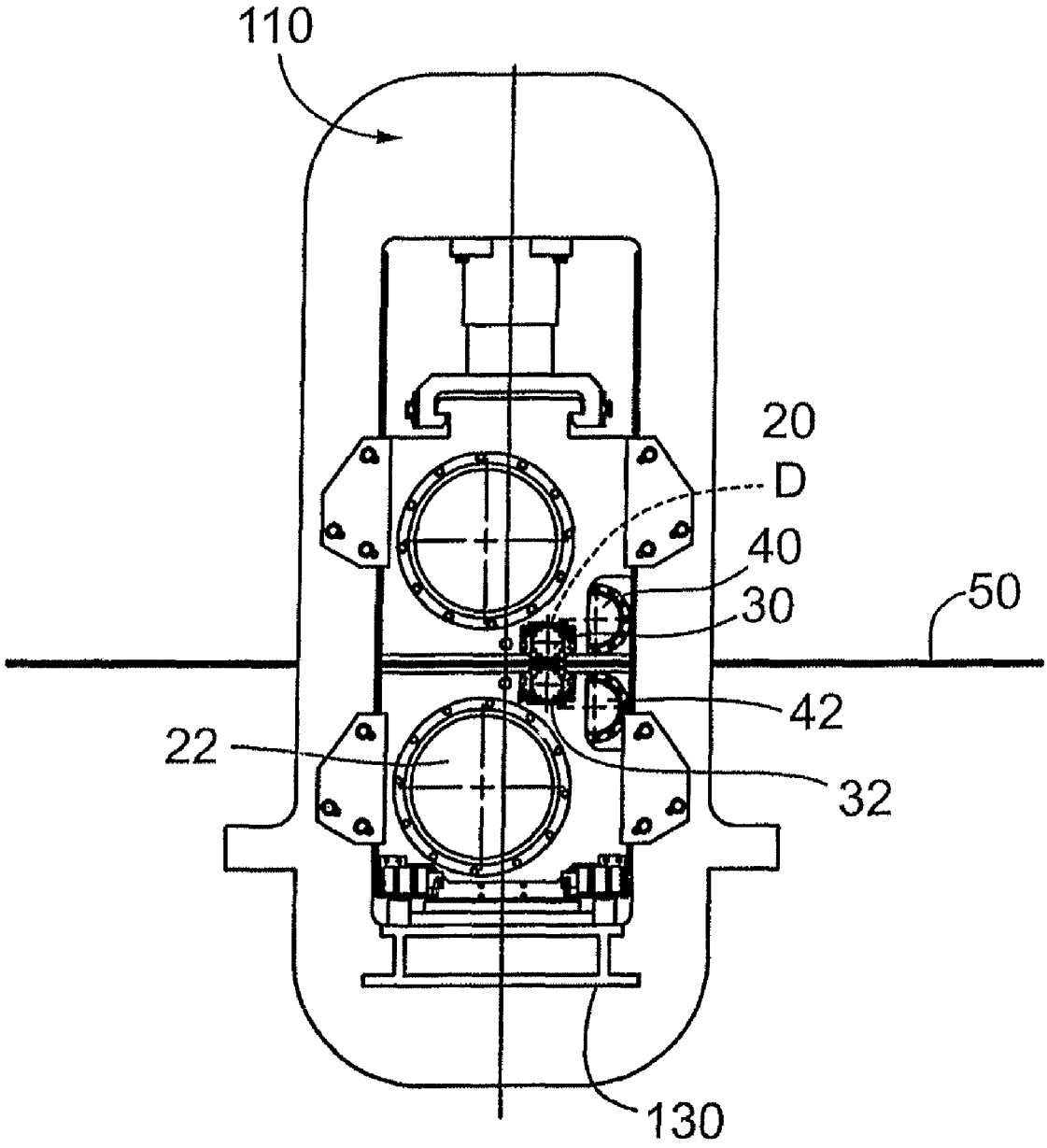
FIG. 20 is a cross sectional view of the six high mill shown in FIG. 18.

FIG. 20 is a side view of the six high mill 100 with the carriage 122 and roller assembly 120 within the frame 110. As shown in FIG. 20, a pair driven backup rolls 20, 22 is located on the entry side of the mill 100, i.e. the left hand side as viewed in FIG. 20. A pair of horizontal support rolls 40, 42 is located on the exit side of the mill 100, i.e. the right hand side as viewed in FIG. 20. A pair of work rolls 30, 32 is positioned between the backup rolls 20, 22 and the horizontal rolls 40, 42 with a large off-set towards the exit side of the mill. Generally, the offset distance will be about 25% to 35% of the backup roll diameter.

The pair of work rolls 30, 32 consists of an upper work roll 30 and a lower work roll 32. The upper and lower work rolls 30, 32 mounted on opposite sides of a strip pass line (superimposed by strip 50 in FIG. 20) and are substantially parallel defining a roll bite 34. During operation, strip 50 is fed into the mill 100 on the entry side and passes in a horizontal direction through the roll bite 34 to the exit side of the mill 100.

Figure 22:
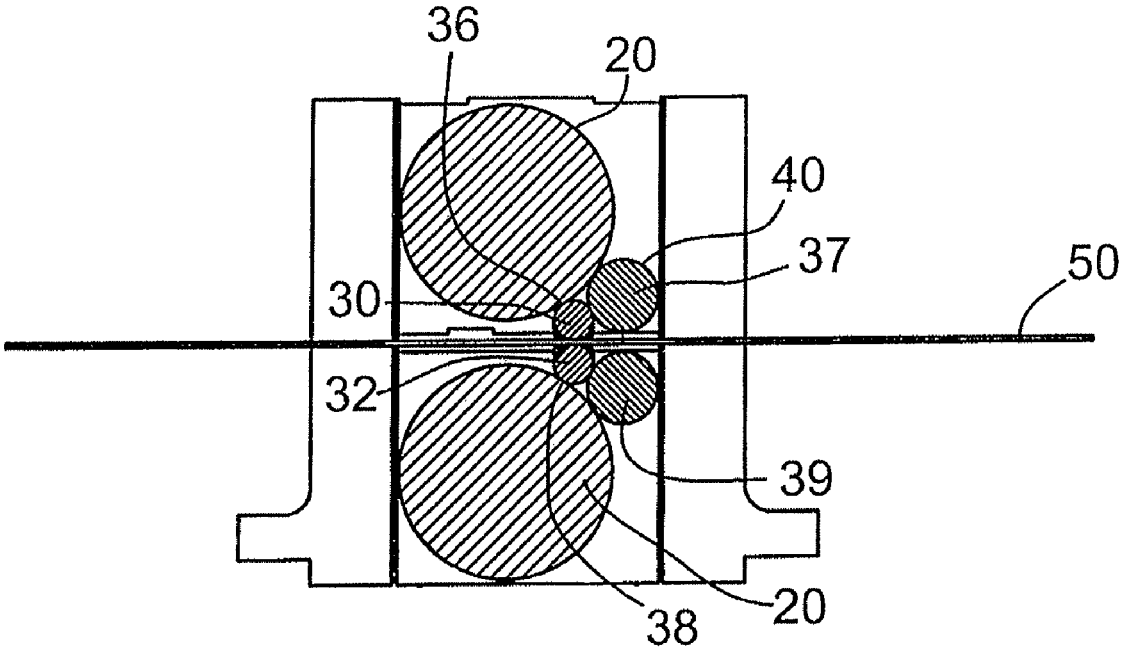
FIG. 22 is a schematic cross-sectional view of the six high mill along axis A-A as shown in FIG. 21.

As shown in FIG. 22, each of the work rolls 30, 32 is backed by one of backup rolls 20, 22. A portion of the entry side face 36, 38 of each work roll 30, 32 can engage a respective backup roll 20, 22. The diameter of the backup rolls 20, 22 is generally between about 100 mm to 800 mm. A portion of the exit side face 37, 39 of each work roll 30, 32 can engage a respective horizontal support roll 40, 42 which provide horizontal stability.

Figure 23:
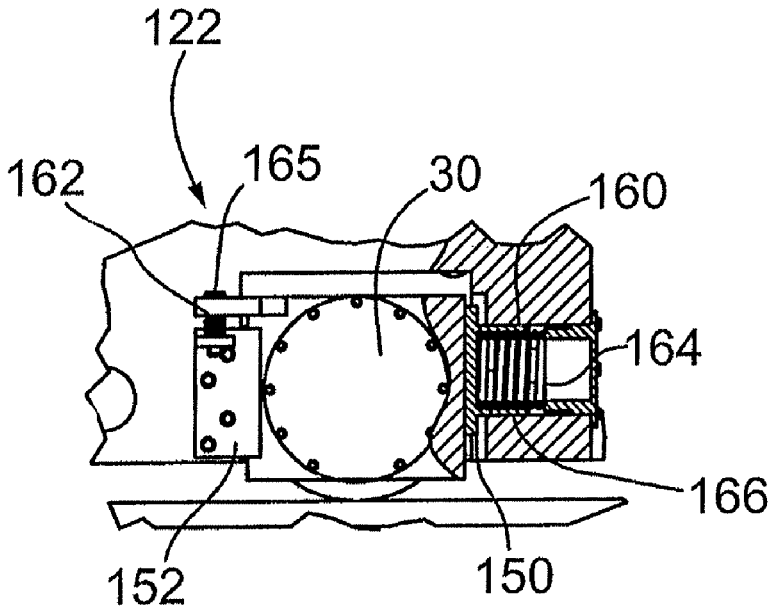
FIG. 23 is an enlarged view off detail D as shown in FIG. 20.

As shown in FIG. 23, each of the upper and lower work rolls 30, 32 are mounted to carriage 122 with chocks 150, 152. The carriage 122 includes a vertical adjustment means comprising two springs (only one spring 1624 is shown) mounted to chock 152. The compressive force in springs 162 may be adjusted with a threaded adjustment member 165 in conventional manner. Further a horizontal adjustment means 160 comprises two springs (only one spring 164 is shown) mounted to chock 150. The springs 162 and 164 allow the work rolls 30, 32 to deflect in accordance with the crown of the strip 50 (not shown).

During operation, a strip 50 is threaded in a conventional matter through the roll bite 34 formed by the upper and lower work rolls 30, 32. As the work rolls 30, 32 have a very small diameter and are comprised of tungsten carbide, and therefore can in use provide high local rigidity, a substantial number of ridges in the strip 50 are effectively flattened to provide a flattened strip which can be cold rolled to provide a final product having reduced numbers of ridge-buckles.

EXAMPLE ONE

Ridge Flattening Efficiency of Conventional Two High, Four High and Six High Rolling Mills versus Six High Rolling Mill having Work Rolls with High Local Rigidity Using simulation software, the ridge flattening capabilities of conventional two high (1000 mm work roll diameter, steel work rolls—elastic modulus 21,000 kgf/mm$^2$), four high (550 mm work roll diameter, steel rolls) and six high rolling mills (350 mm work roll diameter, steel rolls) was compared with the ridge flattening capability of a six high rolling mill having small diameter work rolls with high local rigidity (0.100 mm work roll diameter, tungsten carbide rolls) in accordance with a preferred form of the invention.

Figure 24:
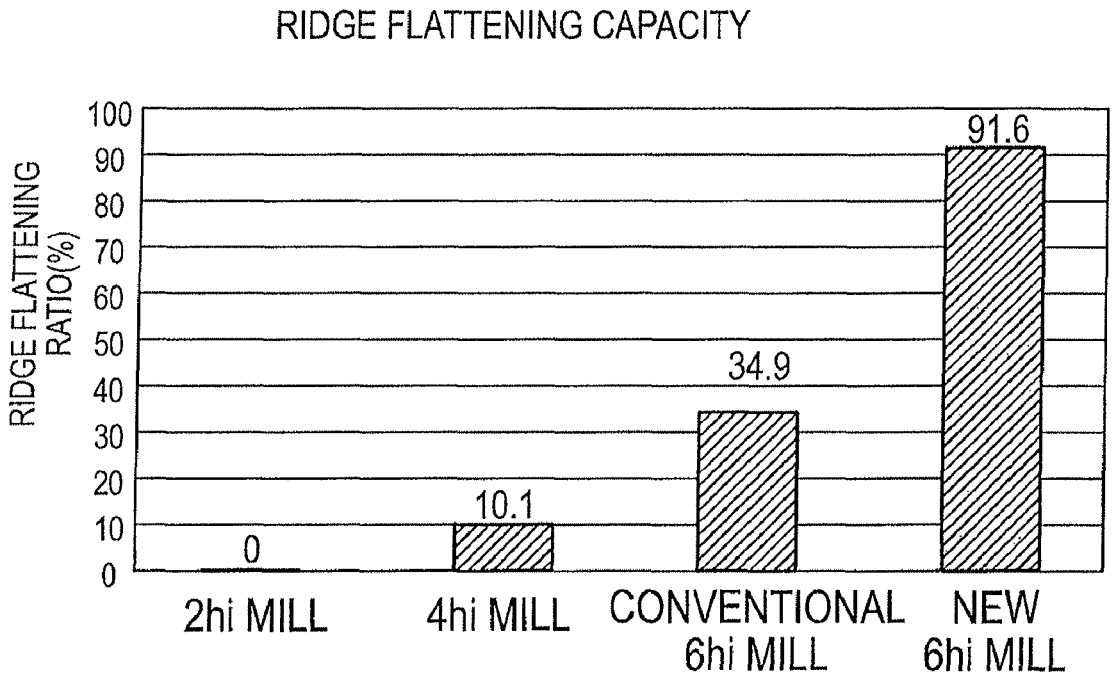
FIG. 24 is a bar graph comparing the ridge flattening capacities of conventional skin pass mills and the six high mill in accordance with an embodiment of the present invention.

As shown in FIG. 24, the conventional two high, four high and six high rolling mills have very poor ridge flattening capacities as compared to the six high rolling mill having small diameter work rolls with high local rigidity. The conventional six high rolling mill had a ridge flattening ratio of only 34.9% as compared to the six high roll rolling mill having small diameter work rolls which had a ridge flattening ration of 91.6%.

These results confirm that conventional skin pass mills are not useful for effectively flattening feedstock ridges. The results demonstrate that a rolling mill having work rolls with high local rigidity is necessary for flattening feedstock ridges.

Although the invention has been described with reference to illustrative embodiments, it is to be understood that the invention is not limited to these precise embodiments, and that various changes and modification are to be intended to be encompassed in the appended claims.

What is claimed is:

1. Method for flattening steel strip by cold rolling said strip by passing it through at least two cold rolling mill stands each having work rolls, wherein a first of said at least two mill stands has said work rolls having local rigidity K significantly different from a second of said at least two mill stands, wherein the local rigidity K is calculated in Kgf/mm/mm accordance with the equation $$K = \frac{1}{\frac{c}{8}\left[\ln\left(\frac{2D}{\Delta h + cp}\right) - \frac{cp}{\Delta h + cp}\right]}$$

where

K—work roll local rigidity (Kgf/mm/mm)

p—roll force per unit strip width (Kgf/mm)

u—local work roll flattening (mm)

D—work roll diameter (mm)

E—work roll elastic modulus (Kgf/mm$^2$)

u—poisson's ratio

Δh—local draft of the strip (mm)

where $$u = \frac{c}{8} p \ln\left(\frac{2D}{\Delta h + cp}\right)$$

and where $$c = \frac{16(1 - \upsilon^2)}{\pi E}$$

and wherein the local rigidity K represents the capability of a work roll to resist local flattening.

2. Method according to claim 1 wherein said strip is passed in sequence through initially said first and through subsequently said second of said mill stands and wherein said work rolls of said first mill stand have significantly higher local rigidity K than said work rolls of said second mill stand.

3. Method according to claim 2 wherein the work rolls of said first mill have a local rigidity K of from about 12,000 kfg/mm/mm to about 120,000 kgf/mm/mm.

4. Method according to claim 2 wherein said first mill stand comprises a cluster mill or a multi-roll mill and said work rolls thereof are tungsten carbide rolls.

5. The method according to claim 2, wherein said first mill stand comprises a six high mill for flattening steel strip, said mill having an entry side where the strip enters the mill and an exit side where the strip exits the mill, said mill comprising:

a pair of driven backup rolls disposed on the entry side of the mill;

a pair of horizontal support rolls disposed on the exit side of the mill;

a pair of small diameter work rolls, said work rolls having an entry side face and an exit side face, wherein said work rolls are disposed between the pair of backup rolls and the pair of support rolls; and wherein said the entry side face of the work rolls is in engagement with the backup rolls during operation and the exit side face of the work rolls is in engagement with the support rolls during operation.

6. A method of reducing ridge buckles in a steel strip comprising the steps of:

passing the steel strip through a first mill stand, the first mill stand having work rolls;

passing the steel strip through at least a second mill stand subsequent to said first mill stand, the second mill stand having work rolls;

wherein said work rolls of said first and second mill stands each have a local rigidity, K, calculated in Kgf/mm/mm in accordance with the equation $$K = \frac{1}{\frac{c}{8}\left[\ln\left(\frac{2D}{\Delta h + cp}\right) - \frac{cp}{\Delta h + cp}\right]}$$

where

K—work roll local rigidity (Kgf/mm/mm)

p—roll force per unit strip width (Kgf/mm)

u—local work roll flattening (mm)

D—work roll diameter (mm)

E—work roll elastic modulus (Kgf/mm$^2$)

U—poisson's ratio

Δh—local draft of the strip (mm)

where $$u = \frac{c}{8} p \ln\left(\frac{2D}{\Delta h + cp}\right)$$

and where $$c = \frac{16(1 - \upsilon^2)}{\pi E};$$

wherein the local rigidity, K, represents the capability of a work roll to resist local flattening; and wherein the local rigidity K of the work rolls of the first mill stand is significantly higher than the local rigidity, K, of the work rolls of the second mill stand.

7. The method according to claim 6, wherein the work rolls of said first mill stand have a local rigidity, K, of from about 12,000 kfg/mm/mm to about 120,000 kgf/mm/mm.

8. The method according to claim 6, wherein the work rolls of said first mill stand are tungsten carbide rolls.

9. The method according to claim 6, wherein the first mill stand is a skin-pass mill and wherein the second mill stand is a cold-rolling mill stand.

10. The method according to claim 6, wherein the steel strip is passed though a third mill stand.

11. The method according to claim 6, wherein the work rolls of the first mill stand comprise a material having an elastic modulus of between about 50,000 kgf/mm$^2$ and about 70,000 kgf/mm$^2$.

12. The method according to claim 6, wherein the work rolls of the first mill stand have a diameter of about 10 mm to 200 mm.

13. The method according to claim 6, wherein the work rolls of the first mill stand have an elastic modulus more than two times higher than the elastic modulus of steel.

* * * * *